US010712018B2

(12) United States Patent
Adelmann et al.

(10) Patent No.: US 10,712,018 B2
(45) Date of Patent: Jul. 14, 2020

(54) DRAWER ASSEMBLY FOR AN OVEN APPLIANCE

(71) Applicant: Haier US Appliance Solutions, Inc., Wilmington, DE (US)

(72) Inventors: Christopher James Adelmann, Louisville, KY (US); Stephen Bernard Froelicher, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1002 days.

(21) Appl. No.: 15/210,925

(22) Filed: Jul. 15, 2016

(65) Prior Publication Data

US 2018/0017268 A1 Jan. 18, 2018

(51) Int. Cl.
*F24C 11/00* (2006.01)
*F24C 15/16* (2006.01)

(52) U.S. Cl.
CPC ..... *F24C 15/162* (2013.01); *F24C 11/00* (2013.01)

(58) Field of Classification Search
CPC ..... F24C 15/162
USPC ..... 126/333, 337 A, 337 R, 339, 340
See application file for complete search history.

(56) References Cited

U.S. PATENT DOCUMENTS 1,938,470 A * 12/1933 Teller ..... F24C 15/162 126/340
2,058,191 A * 10/1936 Teller ..... F24C 15/162 126/340
2,070,049 A * 2/1937 Hillman ..... F24C 15/16 126/340
2,224,164 A * 12/1940 Sherman ..... F24C 15/16 126/14
2,633,841 A * 4/1953 Jenson ..... F24C 15/162 126/340
2,664,878 A * 1/1954 Durant ..... F24C 15/16 126/340
3,830,220 A * 8/1974 Demetreon ..... F24C 15/162 126/340
4,149,518 A * 4/1979 Schmidt ..... F24C 15/162 126/190
4,628,897 A * 12/1986 Stanfa ..... A47J 37/06 126/340
4,637,373 A * 1/1987 Shirai ..... F24C 15/162 126/19 R
7,216,646 B2 * 5/2007 Le ..... F24C 15/16 126/273 R
8,047,199 B2 11/2011 Le et al.
9,587,838 B2 * 3/2017 Stewart ..... F24C 15/168
(Continued)

*Primary Examiner* — Avinash A Savani
(74) *Attorney, Agent, or Firm* — Dority & Manning, P.A.

(57) ABSTRACT

A drawer assembly for an oven appliance is provided. The drawer assembly includes two slide assemblies mounted within a cooking chamber of the oven appliance for supporting a door and a rack assembly. The rack assembly includes a wire support frame for supporting a cooking tray and two support brackets for mounting the wire support frame to the slide assemblies. In this manner, a user may slide the rack assembly and cooking tray out of the cooking chamber by pulling on the door. The wire support frame may be formed from metal using computer numerically controlled machining and may be welded to the support brackets. In this manner, the rack assembly provides a simple, rigid construction that requires a minimal number of parts and is easy to manufacture.

16 Claims, 7 Drawing Sheets

(56) References Cited

U.S. PATENT DOCUMENTS

| | | | | |
|---|---|---|---|---|
| 9,605,853 | B2 * | 3/2017 | Hoffman | F24C 15/16 |
| 9,920,935 | B2 * | 3/2018 | Stewart | F24C 15/168 |
| 9,939,160 | B2 * | 4/2018 | Kim | F24C 15/028 |
| 2004/0112371 | A1 * | 6/2004 | Le | F24C 15/16 126/334 |
| 2005/0174022 | A1 * | 8/2005 | Kuttalek | A47B 88/487 312/410 |
| 2013/0167829 | A1 * | 7/2013 | Lin | F24C 15/162 126/340 |
| 2013/0167830 | A1 * | 7/2013 | Lin | F24C 15/162 126/340 |
| 2015/0354828 | A1 * | 12/2015 | Adelmann | F24C 15/023 126/19 R |
| 2015/0354829 | A1 * | 12/2015 | Adelmann | F24C 15/162 126/19 R |
| 2015/0354830 | A1 * | 12/2015 | Adelmann | F24C 15/162 126/340 |
| 2016/0195279 | A1 * | 7/2016 | Naber | F24C 15/162 126/340 |
| 2016/0195280 | A1 * | 7/2016 | Adelmann | F24C 15/162 126/340 |
| 2018/0073743 | A1 * | 3/2018 | Adelmann | F24C 11/00 |

* cited by examiner

DRAWER ASSEMBLY FOR AN OVEN APPLIANCE

FIELD OF THE INVENTION

The present subject matter relates generally to oven appliances, such as double oven range appliances, and more particularly to drawer assemblies for an oven appliance.

BACKGROUND OF THE INVENTION

Double oven range appliances generally include upper and lower cooking chambers. A user of double oven range appliances may conveniently utilize either or both of the upper and lower cooking chambers to cook food items. Double oven range appliances also generally include two doors, one for providing selective access to the upper cooking chamber and another for providing selective access to the lower cooking chamber. The doors are generally rotatably mounted to a cabinet of the oven appliance with hinges. Thus, the user of the double oven range appliance may rotate the doors open on the hinges in order to access the upper and lower cooking chambers.

In certain double oven range appliances, the upper cooking chamber is smaller than the lower cooking chamber. Thus, the user may utilize the upper cooking chamber to cook smaller food items and the lower cooking chamber to cook larger food items. However, because the upper cooking chamber is relatively small compared to the lower cooking chamber, viewing and/or accessing food items or cookware in the upper cooking chamber can be difficult or awkward. To facilitate access to food items within the upper cooking chamber, the door may be opened and may slide a drawer assembly into and out of the upper cooking chamber. Typical drawer assemblies include two slide assemblies and a rack assembly that supports a cooking tray.

Notably, the rack assembly must be sufficiently sturdy to support the weight of the drawer assembly and food articles placed therein when it is extended from the slide assemblies in a cantilevered position. In addition, the rack assembly must be rigid enough to prevent "racking," or binding of the rack assembly within the cabinet due to misalignment.

Conventional oven appliances use a rack assembly that is constructed from multiple pieces of sheet metal that must be formed into U-shaped brackets and then welded or otherwise fastened together. However, these rack assemblies require multiple parts, involve complicated assembly, and result in heavy rack assemblies.

Accordingly, an oven appliance with an improved rack assembly would be useful. More specifically, a rack assembly requiring fewer parts and a simpler process for manufacturing and assembly while providing sufficient structural rigidity and strength for use in a drawer assembly would be particularly beneficial.

BRIEF DESCRIPTION OF THE INVENTION

The present subject matter provides a drawer assembly for an oven appliance. The drawer assembly includes two slide assemblies mounted within a cooking chamber of the oven appliance for supporting a door and a rack assembly. The rack assembly includes a wire support frame for supporting a cooking tray and two support brackets for mounting the wire support frame to the slide assemblies. In this manner, a user may slide the rack assembly and cooking tray out of the cooking chamber by pulling on the door. The wire support frame may be formed from metal using computer numerically controlled machining and may be welded to the support brackets. In this manner, the rack assembly provides a simple, rigid construction that requires a minimal number of parts and is easy to manufacture. Additional aspects and advantages of the invention will be set forth in part in the following description, or may be apparent from the description, or may be learned through practice of the invention.

In a first exemplary embodiment, an oven appliance is provided. The oven appliance defines a vertical direction, a lateral direction, and a transverse direction, the vertical, lateral, and transverse directions being mutually perpendicular. The oven appliance includes a cabinet defining a cooking chamber and an opening for accessing the cooking chamber of the cabinet, the cabinet extending between a first side portion and a second side portion along the lateral direction, and a heating element positioned at the cooking chamber of the cabinet. A first slide assembly is mounted to the cabinet at the first side portion of the cabinet and a second slide assembly is mounted to the cabinet at the second side portion of the cabinet. The oven appliance further includes a rack assembly mounted to the first and second slide assemblies and extending between the first and second slide assemblies along the lateral direction. The rack assembly includes a first support bracket mounted to the first slide assembly, a second support bracket mounted to the second slide assembly, and a wire support frame mounted to the first support bracket and the second support bracket.

In a second exemplary embodiment, a rack assembly for an oven appliance is provided. The oven appliance includes a cabinet defining a cooking chamber extending between a first side portion and a second side portion. The rack assembly includes a first slide assembly mounted to the cabinet at the first side portion of the cabinet, a second slide assembly mounted to the cabinet at the second side portion of the cabinet, and a wire support frame mounted to and extending between the first slide assembly and the second slide assembly.

According to a third exemplary embodiment, a double oven range appliance is provided. The double oven range defines a vertical direction, a lateral direction, and a transverse direction, the vertical, lateral, and transverse directions being mutually perpendicular. The double oven range appliance includes a cabinet extending between a first side portion and a second side portion along the lateral direction, the cabinet also extending between a top portion and a bottom portion along the vertical direction. The cabinet defines an upper cooking chamber positioned adjacent the top portion of the cabinet and a lower cooking chamber positioned adjacent the lower portion of the cabinet, the cabinet also defining an opening for accessing the upper cooking chamber of the cabinet. A heating element is positioned at the upper cooking chamber of the cabinet. A pair of slide assemblies is mounted to the cabinet at the upper cooking chamber, each slide assembly of the pair of slide assemblies positioned at a respective one of the first and second side portions of the cabinet. A rack assembly is mounted to and extends between the pair of slide assemblies along the lateral direction. The rack assembly includes a first support bracket mounted to the first slide assembly, a second support bracket mounted to the second slide assembly, and a wire support frame mounted to the first support bracket and the second support bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
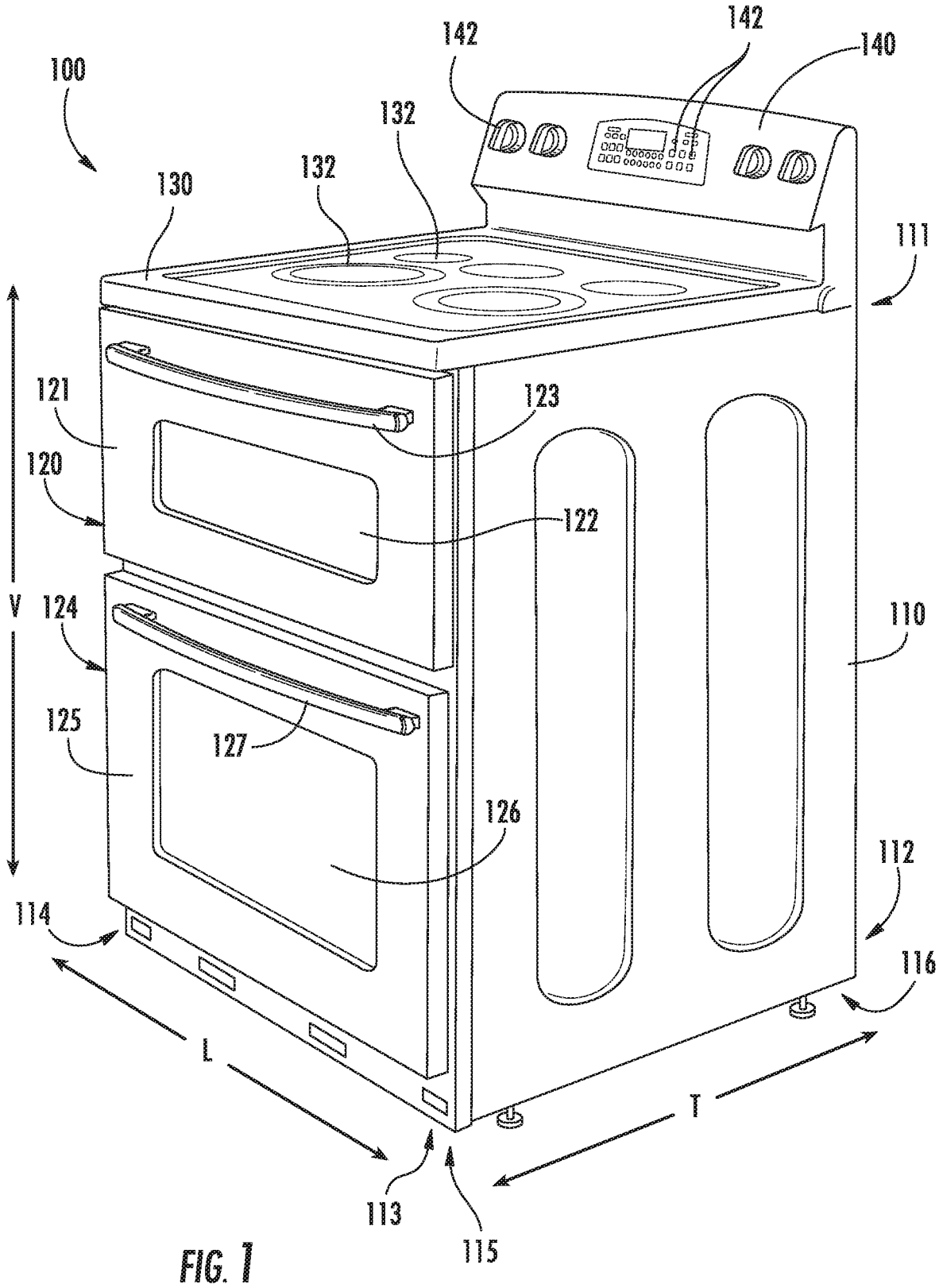
FIGS. 1, 2, 3, and 4 provide perspective views of an oven range appliance according to an exemplary embodiment of the present subject matter with a door of the exemplary oven range appliance shown in various positions and orientations.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1, 2, 3, and 4 provide perspective views of an oven range appliance 100 according to an exemplary embodiment of the present subject matter. In FIGS. 1, 2, 3, and 4, an upper door 121 of range appliance 100 is shown various positions and orientations, as discussed in greater detail below. As may be seen in FIGS. 1, 2, 3, and 4, range appliance 100 defines a vertical direction V, a lateral direction L, and a transverse direction T. The vertical, lateral, and transverse directions are mutually perpendicular and form an orthogonal direction system.

Range appliance 100 includes an insulated cabinet 110. Cabinet 110 extends between a top portion 111 and a bottom portion 112, e.g., along the vertical direction V. Thus, top and bottom portions 111, 112 of cabinet 110 are spaced apart from each other, e.g., along the vertical direction V. Cabinet 110 also extends between a first side portion 113 and a second side portion 114, e.g., along the lateral direction L. Thus, first and second side portions 113, 114 of cabinet 110 are spaced apart from each other, e.g., along the lateral direction L. Cabinet 110 further extends between a front portion 115 and a back portion 116, e.g., along the transverse direction T. Thus, front and back portions 115, 116 of cabinet 110 are spaced apart from each other, e.g., along the transverse direction T.

Range appliance 100 includes a cooktop 130 positioned at or adjacent top portion 111 of cabinet 110. Cooktop 130 includes various heating elements 132, such as gas burners, electric resistance elements, induction elements, etc., that are configured for heating cookware positioned thereon. As may be seen in FIG. 1, cabinet 110 also defines an upper cooking chamber 120 and a lower cooking chamber 124. Thus, range appliance 100 is generally referred to as a double oven range appliance. As will be understood by those skilled in the art, range appliance 100 is provided by way of example only, and the present subject matter may be used in any suitable oven appliance, e.g., a single oven range appliance, a single wall oven appliance, a double wall oven appliance, etc.

Upper cooking chamber 120 is positioned at or adjacent top portion 111 of cabinet 110. Conversely, lower cooking chamber 124 is positioned at or adjacent bottom portion 112 of cabinet 110. Thus, upper and lower cooking chambers 120, 124 are spaced apart from each other along the vertical direction V. Upper and lower cooking chambers 120, 124 can have any suitable size relative to each other. For example, as shown in FIG. 1, upper cooking chamber 120 may be smaller than lower cooking chamber 124.

Upper and lower cooking chambers 120, 124 are configured for receipt of one or more food items to be cooked. Range appliance 100 includes an upper door 121 and a lower door 125 that are attached or coupled to cabinet 110, e.g., with drawer assemblies and rack assemblies as discussed in greater detail below, in order to permit selective access to upper cooking chamber 120 and lower cooking chamber 124, respectively. Handles 123, 127 are mounted to upper and lower doors 121, 125 to assist a user with opening and closing doors 121, 125 in order to access cooking chambers 120, 124. As an example, a user can pull on handle 123 mounted to upper door 121 to open or close upper door 121 and access upper cooking chamber 120. Glass window panes 122, 126 provide for viewing the contents of upper and lower cooking chambers 120, 124 when doors 121, 125 are closed and also assist with insulating upper and lower cooking chambers 120, 124. Heating elements such as electric resistance heating elements, gas burners, microwave elements, etc., are positioned within upper and lower cooking chambers 120, 124 of cabinet 110 for heating upper and lower cooking chambers 120, 124. According to the illustrated exemplary embodiment of FIG. 5, a heating element 160 is positioned within upper cooking chamber 120 and is configured for selectively heating upper cooking chamber 120.

A control panel 140 of range appliance 100 is positioned at top portion 111 and back portion 116 of cabinet 110. Control panel 140 includes user inputs 142. Control panel 140 provides selections for user manipulation of the operation of range appliance 100. For example, a user can touch control panel 140 to trigger one of user inputs 142. In response to user manipulation of user inputs 142, various components of the range appliance 100, such as heating element 160, can be operated.

Figure 2:
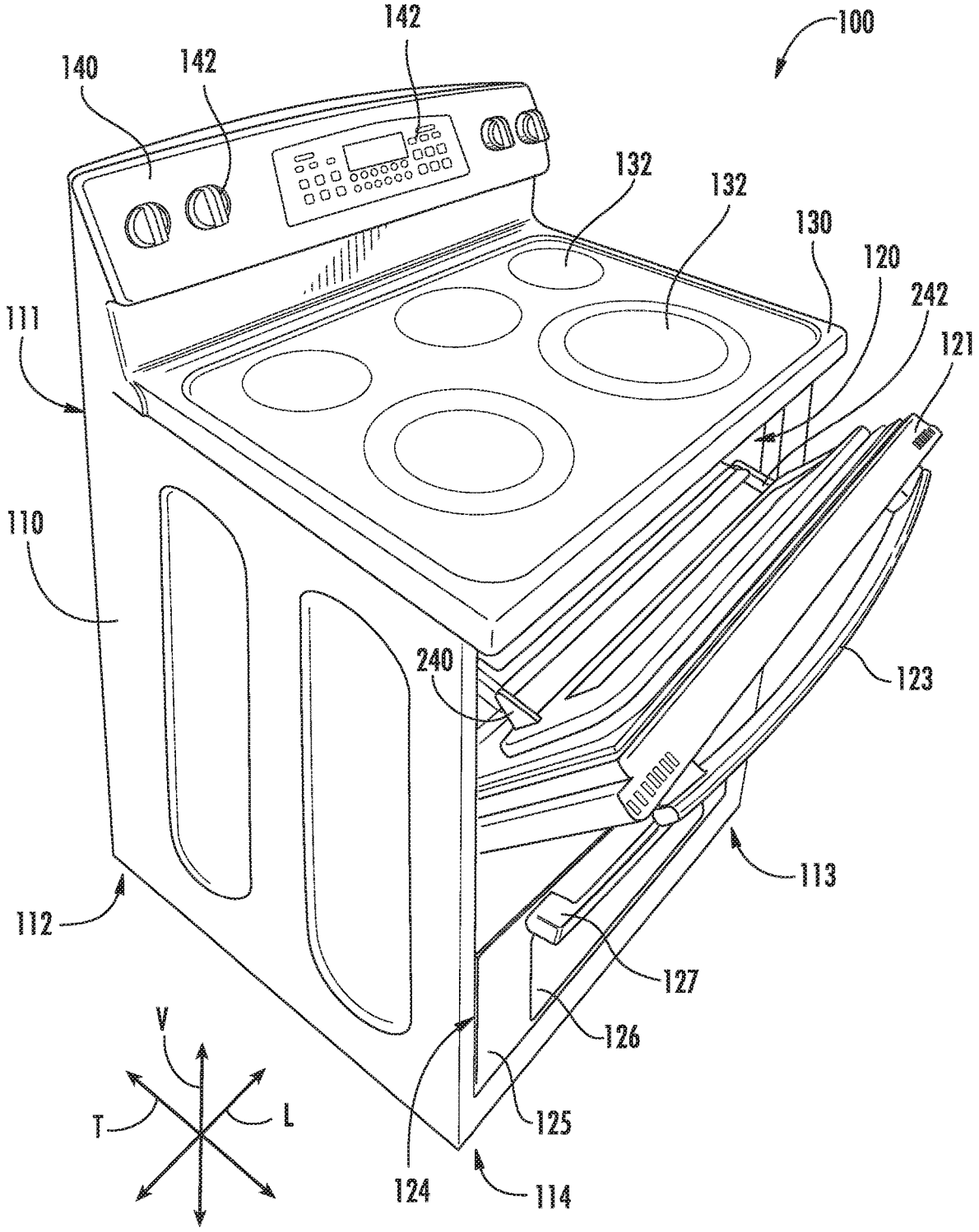
Figure 3:
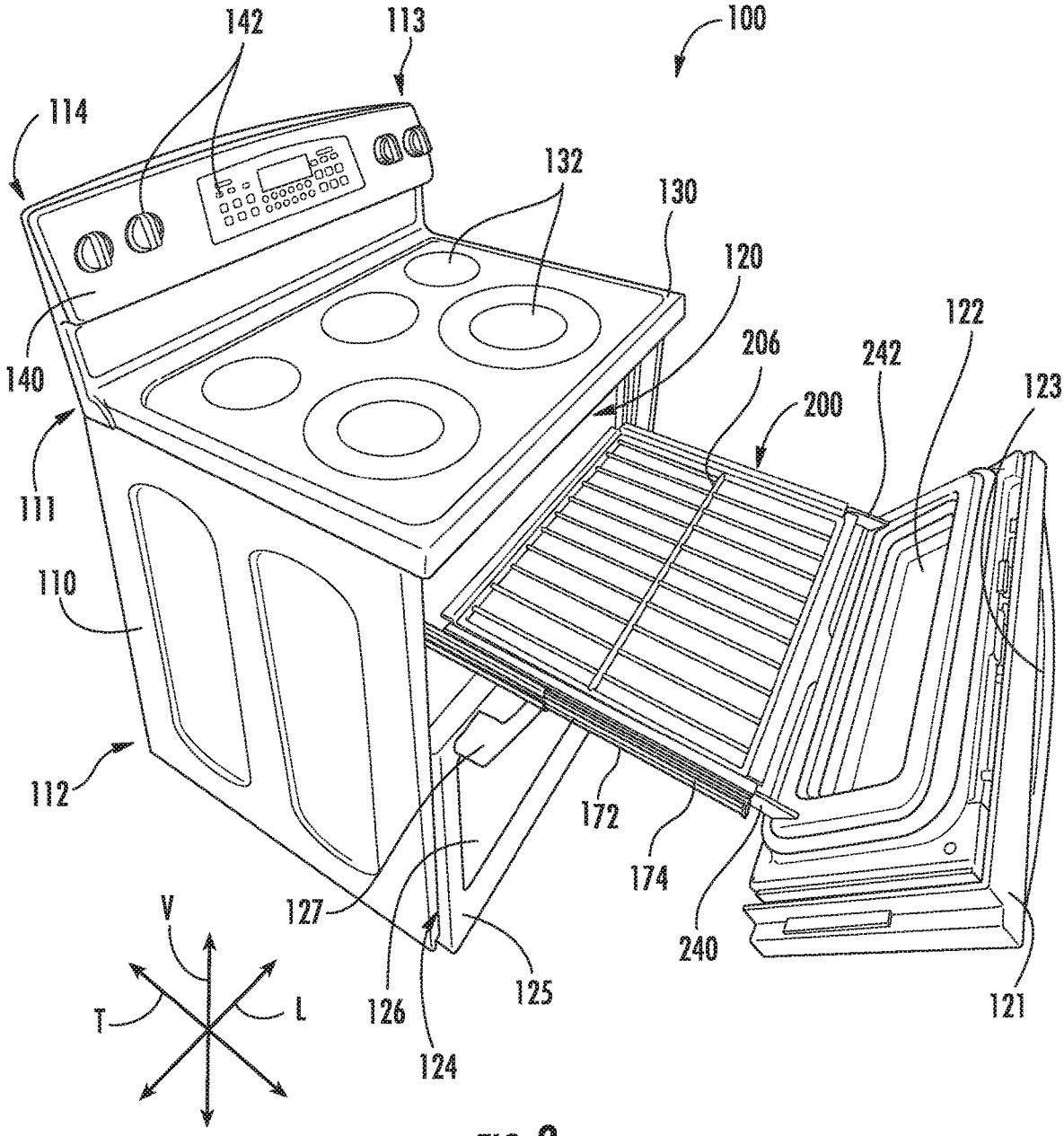

As may be seen in FIGS. 1, 2, 3, and 4, upper door 121 may be positioned and oriented in a variety of configurations and positions. For example, door 121 is shown in a closed position and a vertical configuration in FIG. 1. As another example, upper door 121 is shown in the closed position and a non-vertical configuration in FIG. 2. In FIG. 3, upper door 121 is shown in an open position and the non-vertical configuration. Conversely, upper door 121 is shown in the open position and the vertical configuration in FIG. 4. A user of range appliance 100 may adjust upper door 121 between the various positions and configurations shown in FIGS. 1, 2, 3, and 4. For example, the user may grasp handle 123 of upper door 121 and move upper door 121, e.g., along the transverse direction T, between the closed and open positions and/or pivot upper door 121, e.g., on an axis that is parallel to the lateral direction L, between the vertical and non-vertical configurations.

To permit movement of upper door 121, e.g., along the transverse direction T, range appliance 100 includes a pair of slide assemblies or slide rails 172 that slidably couple upper door 121 to cabinet 110. Slide assemblies 172 are mounted to cabinet 110 at or adjacent upper cooking chamber 120. Each slide assembly of slide assemblies 172 are positioned at a respective one of the first and second side portions 113, 114 of cabinet 110. In particular, slide assemblies 172 include a first slide assembly or set of slide rails 174 and a second slide assembly or set of slide rails 176. First slide assembly 174 is mounted to cabinet 110 at or adjacent first side portion 113 of cabinet 110, and second slide assembly 176 is mounted to cabinet 110 at or adjacent second side portion 114 of cabinet 110.

Slide assemblies 172 may be mounted to any suitable component of cabinet 110 and positioned at any suitable location on cabinet 110. For example, slide assemblies 172 may be mounted to cabinet 110 within upper cooking chamber 120. Thus, slide assemblies 172 may be positioned within upper cooking chamber 120, e.g., when upper door 121 is in the closed position. As another example, slide assemblies 172 may be mounted to cabinet 110 outside of upper cooking chamber 120. Thus, slide elements 172 may be positioned such that slide elements 172 are shielded from upper cooking chamber 120 and, e.g., not exposed to heated air within or from upper cooking chamber 120 when upper door 121 is in the closed position.

As may be seen in FIG. 2, cabinet 110 defines an opening 118 for accessing upper cooking chamber 120 of cabinet 110. Upper door 121 is positioned at or adjacent opening 118 of cabinet 110 when upper door 121 is in the closed position. Conversely, upper door 121 is spaced apart from cabinet 110, e.g., opening 118 of cabinet 110, along the transverse direction T when upper door 121 is in the open position. For example, upper door 121 may move along the transverse direction T on slide assemblies 172 such that upper door 121 is spaced apart from opening 118 of cabinet 110 by at least one foot along the transverse direction T when upper door 121 is in the open position.

As discussed above, upper door 121 is pivotable, e.g., on an axis that is parallel to the lateral direction L, between the vertical and non-vertical configurations. For example, upper door 121 may be pivotable by at least thirty degrees, e.g., about an axis that is parallel to the lateral direction L, between the vertical and non-vertical positions. As another example, upper door 121 may be pivotable by at least sixty degrees, e.g., about an axis that is parallel to the lateral direction L, between the vertical and non-vertical positions. As yet another example, upper door 121 may be pivotable by about ninety degrees, e.g., about an axis that is parallel to the lateral direction L, between the vertical and non-vertical positions.

When upper door 121 is in the closed position and the vertical configuration as shown in FIG. 1, upper door 121 seals or closes upper cooking chamber 120. Thus, such position and orientation of upper door 121 may be used when cooking food items within upper cooking chamber 120. If a user wants to check on the food items, the user may pivot upper door 121 to the non-vertical position in order to allow the user to view and observe the food items within upper cooking chamber 120. Thus, when upper door 121 is in the closed position and the non-vertical configuration as shown in FIG. 2, upper door 121 may be positioned and oriented to allow the user to view food items within upper cooking chamber 120 without removing the food items from upper cooking chamber 120. Upper door 121 is also pivotable between the vertical and non-vertical configurations when upper door 121 is in the open position as may be seen in FIGS. 3 and 4.

Range appliance 100 also includes a rack assembly 200 that includes features for supporting food items thereon. Rack assembly 200 is slidably coupled to cabinet 110, e.g., with slide assemblies 172, such that rack assembly 200 moves with upper door 121 along the transverse direction T. Thus, food items on rack assembly 200 may be, e.g., at least partially, removed from upper cooking chamber 120 by shifting door 121 from the closed position to the open position. In particular, with food items cooking within upper cooking chamber 120, a user of range appliance 100 may avoid having to reach into upper cooking chamber 120 in order to grasp or handle the food items located therein by grasping handle 123 of upper door 121 and shifting upper door 121 to the open position such that rack assembly 200 slides out of upper cooking chamber 120. Similarly, if the user wants to check on the food items, the user may move upper door 121 to the open position in order to remove the food items from upper cooking chamber 120 and allow the user to view and observe the food items outside of upper cooking chamber 120. Rack assembly 200 is discussed in greater detail below.

Figure 5:
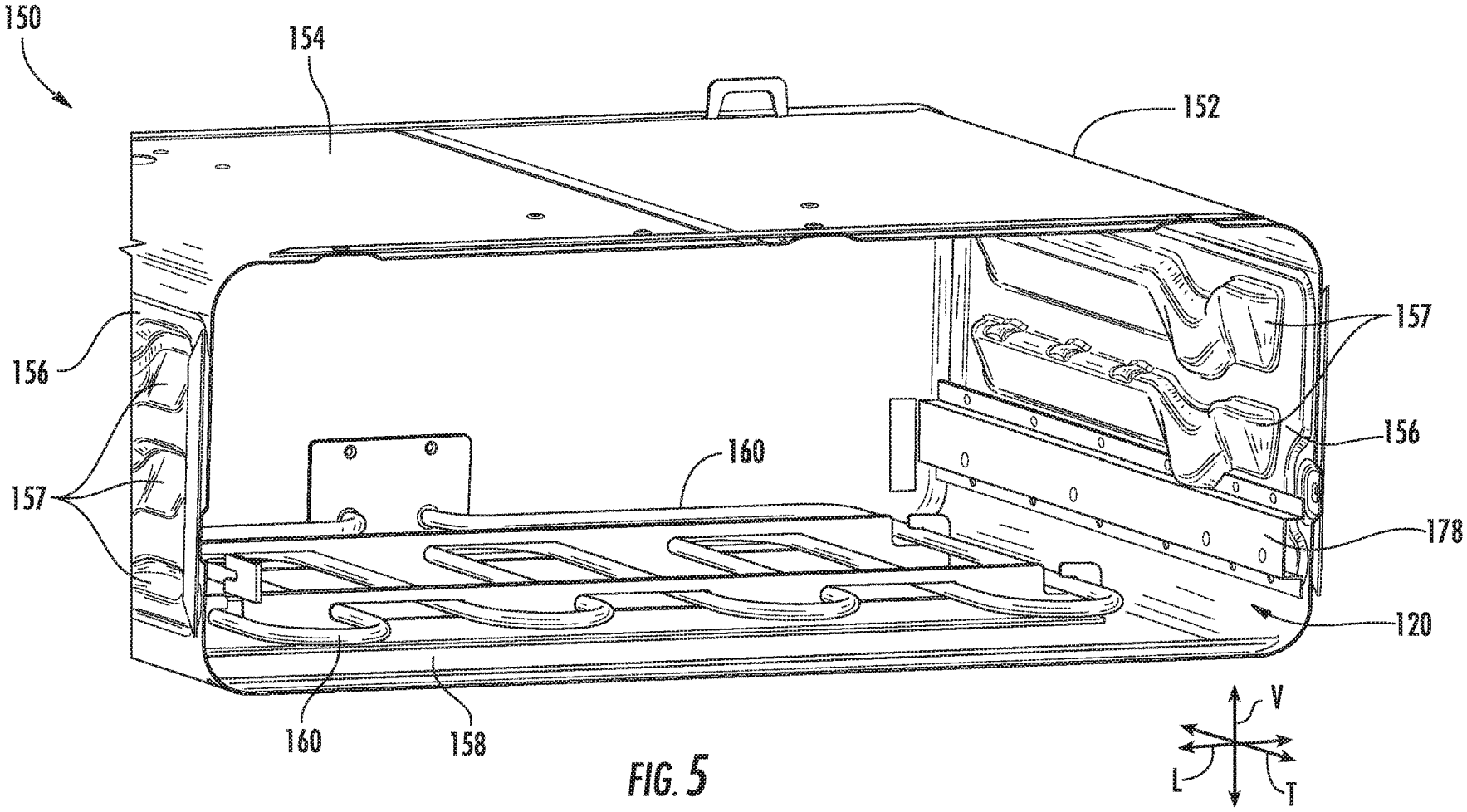
FIG. 5 provides a perspective view of certain components of a drawer assembly of the exemplary oven range appliance of FIG. 1

FIG. 5 provides a perspective view of certain components of a drawer assembly 150 of range appliance 100. Drawer assembly 150 includes various components of range appliance 100 associated with upper cooking chamber 120, including upper door 121, slide assemblies 172, rack assembly 200, etc. It should be understood that lower cooking chamber 124 may be constructed in similar manner as upper cooking chamber 120 and range appliance 100 may include similar features and components for lower cooking chamber 124. Thus, lower door 125 may be mounted to slide assemblies such that lower door 125 is movable along the transverse direction T and may also be pivotable about an axis that is parallel the lateral direction L.

As may be seen in FIG. 5, drawer assembly 150 includes a chamber liner 152 that assists with defining upper cooking chamber 120. Chamber liner 152 includes a top wall 154, side walls 156, and a bottom wall 158. Top and bottom walls 154, 158 of chamber liner 152 are spaced apart from each other, e.g., along the vertical direction V. Side walls 156 of chamber liner 152 extend between and connect top and bottom walls 154, 158 of chamber liner 152, e.g., along the vertical direction V. Chamber liner 152 may be constructed of or with any suitable material. For example, chamber liner 152 may be constructed with a metal, such as steel, with a suitable coating, such as enamel. In particular, a single sheet of metal may be folded, bent or otherwise deformed to form top wall 154, side walls 156, and bottom wall 158 of chamber liner 152. As another example, top wall 154, side walls 156, and bottom wall 158 of chamber liner 152 may be formed of or with discrete metal panels.

Each side wall of side walls 156 may include or define embossed supports 157, e.g., that extend along the transverse direction T. Embossed supports 157 may be distributed along the vertical direction V, and each embossment 157 on one of side walls 156 may be aligned with a respective embossment 157 on the other one of side walls 156. A rack (not shown) may be supported on embossed supports 157.

For example, the rack may be inserted between adjacent embossed supports 157 one each side wall 156.

Drawer assembly 150 further includes at least one hat bracket 178. Hat bracket 178 is mounted to one of side walls 156 within upper cooking chamber 120. In particular, hat bracket 178 is mounted to one of side walls 156 such that hat bracket 178 is positioned over one of embossed supports 157. One of slide assemblies 172, e.g., second slide assembly 176, is mounted to hat bracket 178. In particular, a slide rail of second slide assembly 176 may be mounted or fastened to hat bracket 178. Hat bracket 178 provides a flat surface for mounting one of slide assemblies 172 in upper cooking chamber 120 over one of embossed supports 157. Thus, hat bracket 178 may extend over one of the embossed supports 157 and be mounted to one of side walls 156 of chamber liner 152.

It should be understood that in alternative exemplary embodiments, range appliance 100 need not include hat bracket 178. For example, when side walls 156 of chamber liner 152 do not include embossed supports 157, slide assemblies 172 may be directly mounted to side walls 156 of chamber liner 152 within upper cooking chamber 120. Similarly, slide assemblies 172 may be mounted to side walls 156 of chamber liner 152 with an adapter plate when side walls 156 of chamber liner 152 do not include embossed supports 157.

Figure 6:
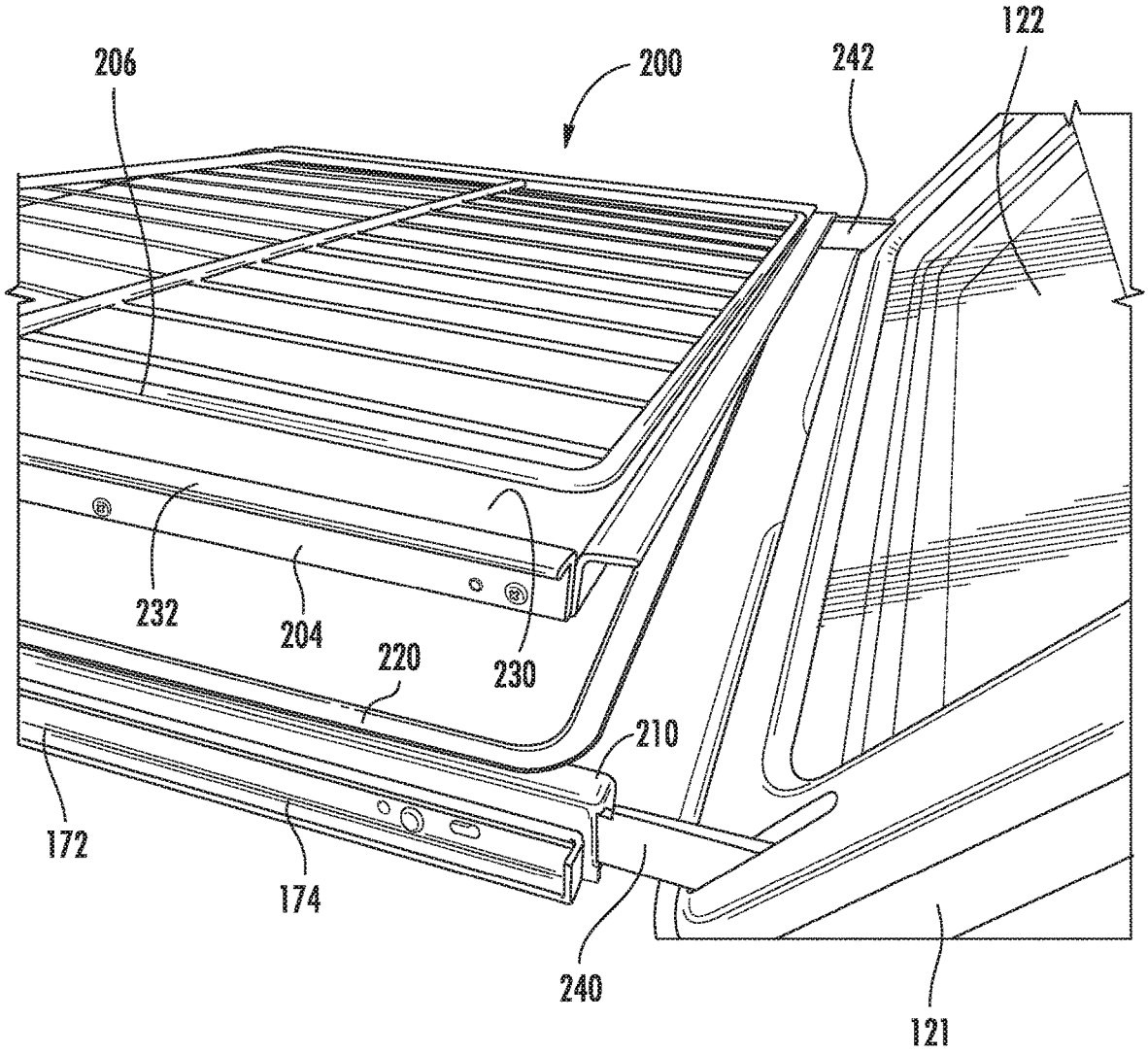
FIG. 6 provides a perspective view of the drawer assembly and a rack assembly of the exemplary oven range appliance of FIG. 1 with the rack assembly partially exploded.
Figure 7:
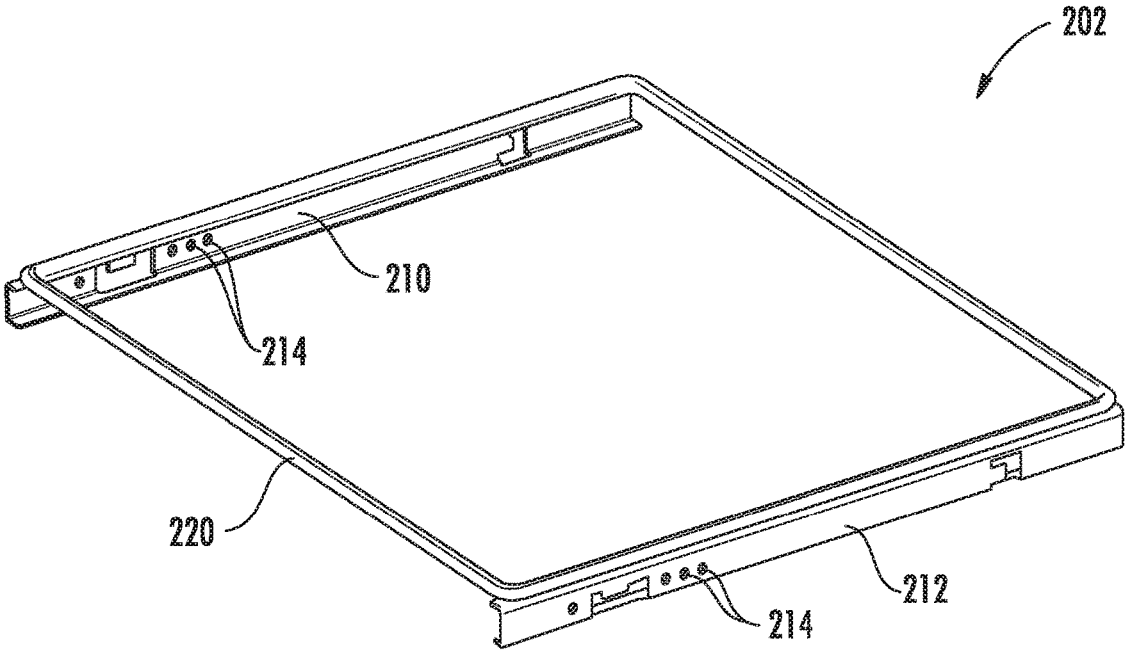
FIG. 7 provides a perspective view of the exemplary rack assembly of FIG. 6.
Figure 8:
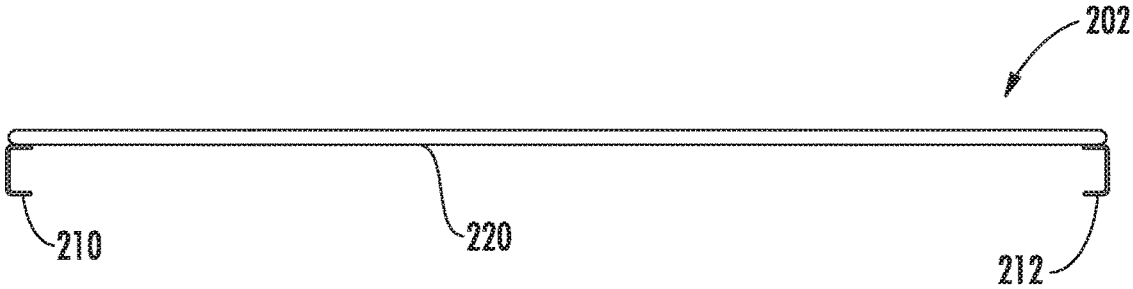
FIG. 8 provides a front view of the exemplary rack assembly of FIG. 6.
Figure 9:
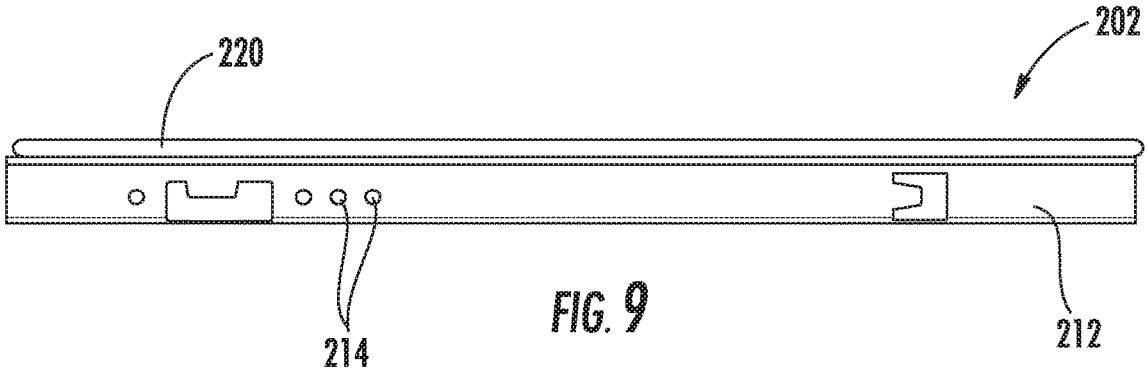
FIG. 9 provides a side view of the exemplary rack assembly of FIG. 6.

FIGS. 6 through 9 illustrate a rack assembly 200 according to an exemplary embodiment of the present subject matter. More specifically, FIG. 6 provides a perspective view of rack assembly 200 as installed in drawer assembly 150 and shown partially exploded. FIGS. 7 through 9 provide perspective, front, and side views, respectively, of rack assembly 200. As may be seen in FIG. 6, rack assembly 200 includes a frame assembly 202, a tray 204, and a rack 206. Frame assembly 202, tray 204, and rack 206 may each have a substantially rectangular shape or form, e.g., in a plane that is perpendicular to the vertical direction V. Thus, frame assembly 202, tray 204, and rack 206 may be nested or set together within upper cooking chamber 120.

As best illustrated in FIGS. 7 through 9, frame assembly 202 includes a first support bracket 210 and a second support bracket 212. According to the illustrated embodiment, support brackets 210, 212 are mounted to slide rails of the slide assemblies 172 (FIG. 6). More specifically, first support bracket 210 is mounted to slide rail 174 and second support bracket 212 is mounted to slide rail 176 such that slide rails 174, 176 and support brackets 210, 212 both extend along the transverse direction T. Support brackets 210, 212 may be mounted to slide rails 174, 176 using any suitable mechanical fastener, such as screws, bolts, rivets, etc. Similarly, glue, bonding, welding, snap-fit mechanisms, interference-fit mechanisms, or any suitable combination thereof be used to join support brackets 210, 212 and slide rails 174, 176.

Support brackets 210, 212 may be formed from any suitably rigid material, e.g., steel. According to the illustrated embodiment, support brackets 210, 212 are constructed from a piece of sheet metal that is formed into a U-shape for additional structural support. A variety of apertures 214 may be punched in each support bracket 210, 212, e.g., for mounting support brackets 210, 212 using mechanical fasteners. According to an alternative embodiment, any suitably rigid and elongated support member may be used in place of support brackets 210, 212, e.g., a hollow metal tube.

Frame assembly 202 further includes a wire support frame 220. Wire support frame 220 is generally any suitable structural member that extends between first support bracket 210 and second support bracket 212 to form a rigid assembly. According to the illustrated embodiment, wire support frame 220 is a single piece of wire that has been formed to have a substantially rectangular shape or form. Wire support frame 220 may be constructed using any suitable material that may be formed into a substantially rectangular shape while providing substantial strength and rigidity, particularly when mounted to support brackets 210, 212.

According to an example embodiment, wire support frame 220 is formed out of a piece of wire having a circular cross section. The metal may be steel or any other suitably rigid and formable material. The wire support frame 220 may be formed using computer numerically controlled machining. Using this process, a computer may be configured to cut a piece of wire to the desired length and form four 90 degree corners at the desired locations. The two cut ends of the wire may then be joined using any suitable metal joining technique, e.g., welding. However, according to an alternative embodiment, the ends of the cut wire need not be joined at all. Instead, the joint where the ends meet may be positioned along one of support brackets 210, 212 to fix the two ends together and provide a rigid structure.

According to the illustrated embodiment, wire support frame 220 is mounted directly to support brackets 210, 212 by welding, although other suitable means of fixing wire support frame 220 to support brackets 210, 212 are possible. Moreover, according to alternative embodiments, frame assembly 202 need not include support brackets 210, 212 at all. For example, in such an embodiment, wire support frame 220 may be mounted directly to slide rails 174, 176.

Whether wire support frame 220 is mounted directly or indirectly to slide assemblies 172, wire support frame 220 extends between slide assemblies 172, e.g., along the lateral direction L. In this manner, wire support frame 220 rigidly couples slide assemblies 172 together in order to hinder racking or misalignment of rack assembly 200. Thus, wire support frame 220 may couple slide assemblies 172 together such that slide assemblies 172 extend simultaneously or at a common velocity during adjustment of upper door 121 between the open and closed positions.

Tray 204 is removably mounted to wire support frame 220, and rack 206 is disposed on tray 204. Rack 206 is configured for supporting food items thereon. Tray 204 is positioned below rack 206 and above heating element 160, e.g., along the vertical direction V. Thus, tray 204 may be positioned for catching and collecting food particles and/or liquid spills from food items on rack 206 in order to hinder or prevent such food particles and/or liquid spills from contacting heating element 160. In particular, tray 204 includes a recessed portion 230 and a lip 232 that extends about recessed portion 230 of tray 204. Recessed portion 230 of tray 204 is disposed within wire support frame 220, and lip 232 of tray 204 is positioned on wire support frame 220 when tray 204 is mounted to wire support frame 220. Thus, lip 232 of tray 204 holds or supports recessed portion 230 of tray 204 within wire support frame 220 such that recessed portion 230 of tray 204 is positioned for collecting food particles and/or liquid spills from food items on rack 206.

Tray 204 and rack 206 may be constructed of or with any suitable material. For example, tray 204 may be constructed with a metal, such as steel. Tray 204 may be formed from a single piece of stamped and formed sheet metal or may be constructed from multiple pieces and joined together, e.g., by welding. Rack 206 may be constructed with elongated metal rods or wire members that are connected to one another, e.g., welded, fastened, etc., in order to form rack 206. Tray 204 and/or rack 206 may further be coated with any suitable coating, such as enamel.

Figure 4:
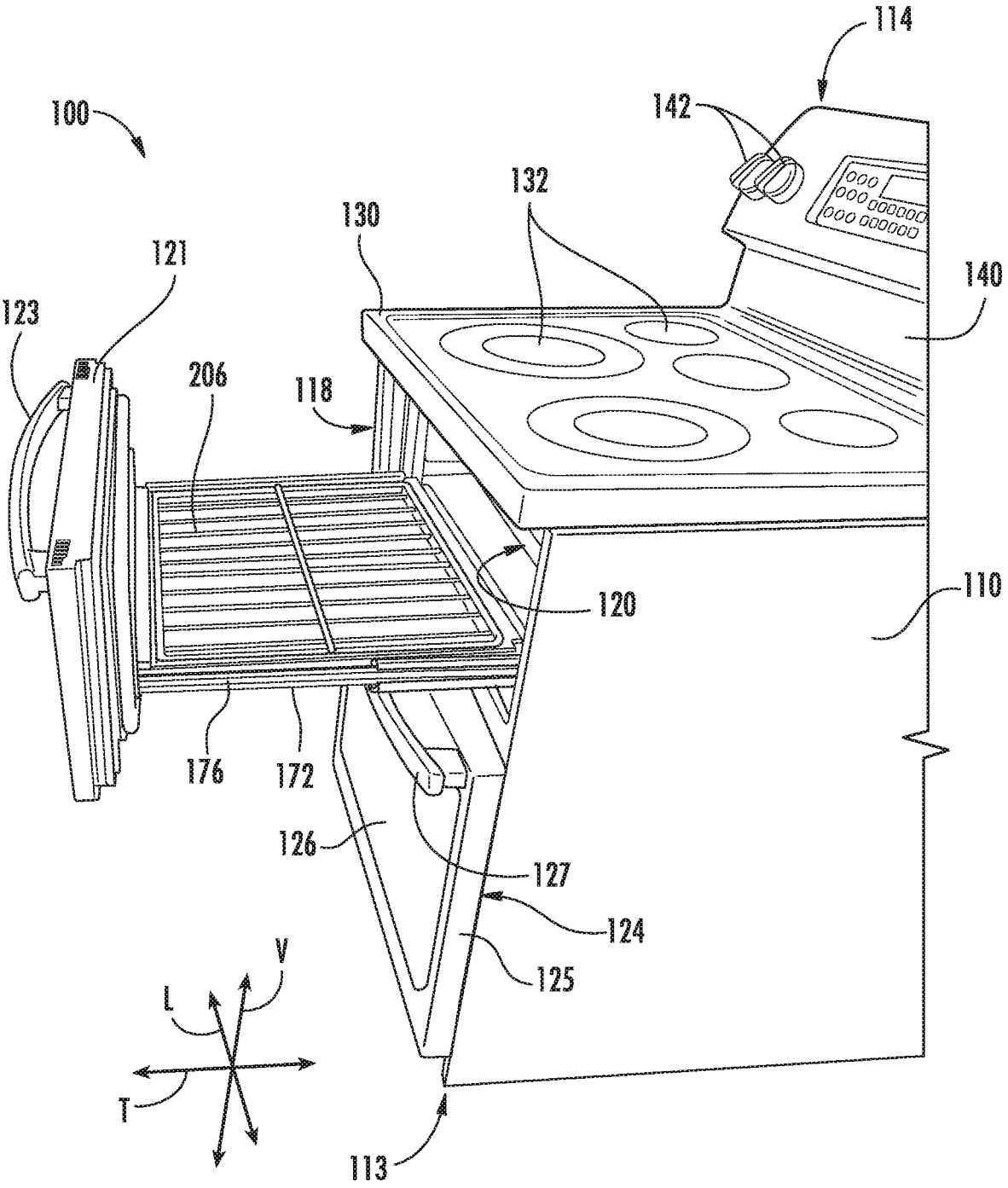

Turning back to FIGS. 1 and 2, rack 206 may be positioned within upper cooking chamber 120 when upper door 121 is in the closed position. Conversely, at least a portion of rack 206 is positioned outside of the upper cooking chamber 120 when upper door 121 is in the open position as shown in FIGS. 3 and 4. As an example, at least fifty percent of rack 206 may be disposed outside of upper cooking chamber 120 when upper door 121 is in the open position. As another example, at least ninety percent of rack 206 may be disposed outside of upper cooking chamber 120 when upper door 121 is in the open position. As yet another example, all of rack 206 may be disposed outside of upper cooking chamber 120 when upper door 121 is in the open position.

Notably, when upper door 121 is positioned in the closed position at cabinet 110, tray 204 is positioned over heating element 160, e.g., along the vertical direction V. In particular, tray 204 may be positioned directly over heating element 160 along the vertical direction V such that tray 204 covers heating element 160 and is disposed between heating element 160 and rack 206 along the vertical direction V when upper door 121 is in the closed position. Such positioning of tray 204 may assist with shielding heating element 160 from food particles and liquid spills. Tray 204 may also assist with uniform heating of food items within upper cooking chamber 120. For example, tray 204 may act as a radiant heat emitter during operation of heating element 160.

As best shown in FIG. 6, upper door 121 may be pivotally mounted to drawer assembly 150 by door support arms. More specifically, a first door support arm 240 and a second door support arm 242 may extend from rack assembly 200 along the transverse direction T. A hinge assembly (not shown) may be used to establish the pivotal connection between upper door 121 and rack assembly 200 such that upper door 121 is pivotable between the vertical and non-vertical positions. Any suitable pivotal connection may be used. According to one exemplary embodiment, a hinge mechanism as illustrated in U.S. Patent Application Publication No. 2015/0354830, which is incorporated herein by reference in its entirety for all purposes, may be used to pivotally connect upper door 121 to rack assembly 200.

According to the illustrated embodiment, first door support arm 240 is mounted to and extends from first support bracket 210 and second door support arm 242 is mounted to and extends from second support bracket 212. However, according to an alternative embodiment, door support arms 240, 242 may be connected instead to slide rails 174, 176, or to any other suitable portion of drawer assembly 150.

Notably, slide assemblies 172, wire support frame 220 of rack assembly 200, and the hinge assembly are coupled to each other such that force is transferred between such components in a planar or linear manner. For example, slide assemblies 172, wire support frame 220 of rack assembly 200, and the hinge assembly may be positioned coplanar with each other, e.g., in a plane that is perpendicular to the vertical direction V. Thus, when a user pulls on upper door 121, force applied by the user is transferred within the plane between such components. In such a manner, upper drawer 121 may slide or adjust more easily between the open and closed positions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction, and a transverse direction, the vertical, lateral, and transverse directions being mutually perpendicular, the oven appliance comprising: a cabinet defining a cooking chamber and an opening for accessing the cooking chamber of the cabinet, the cabinet extending between a first side portion and a second side portion along the lateral direction; a heating element positioned at the cooking chamber of the cabinet; a first slide assembly mounted to the cabinet at the first side portion of the cabinet and being movable along the transverse direction relative to the cabinet; a second slide assembly mounted to the cabinet at the second side portion of the cabinet and being movable along the transverse direction relative to the cabinet; and a rack assembly mounted to the first and second slide assemblies and extending between the first and second slide assemblies along the lateral direction, the rack assembly comprising: a first support bracket mounted to the first slide assembly; a second support bracket mounted to the second slide assembly; and a wire support frame mounted to the first support bracket and the second support bracket wherein the rack assembly comprises a tray that is removably mounted to the wire support frame and wherein the tray comprises a recessed portion and a lip that extends about the recessed portion, the recessed portion of the tray disposed within the wire support frame and the lip of the tray positioned on the wire support frame when the tray is mounted to the wire support frame.

2. The oven appliance of claim 1, wherein the wire support frame comprises a single piece of wire that is formed into a rectangle.

3. The oven appliance of claim 1, wherein the wire support frame is formed by computer numerically controlled machining.

4. The oven appliance of claim 1, wherein the wire support frame is welded to the first support bracket and the second support bracket.

5. The oven appliance of claim 1, wherein the rack assembly comprises a rack removably mounted on the tray.

6. The oven appliance of claim 1, wherein the wire support frame has a circular cross section.

7. The oven appliance of claim 1, wherein the wire support frame is constructed from metal.

8. The oven appliance of claim 1, further comprising a door positioned adjacent the opening of the cabinet, the first slide assembly and the second slide assembly coupling the door to the cabinet such that the door is movable along the transverse direction relative to the cabinet, the door being pivotable between a vertical position and a non-vertical position.

9. The oven appliance of claim 8, wherein the rack assembly further comprises a first door support arm mounted to the first support bracket and a second door support arm mounted to the second support bracket, the door being pivotally connected to the first door support arm and the second door support arm.

10. A rack assembly for an oven appliance, the oven appliance comprising a cabinet defining a cooking chamber extending between a first side portion and a second side portion, the rack assembly comprising: a first slide assembly mounted to the cabinet at the first side portion of the cabinet and being movable along a transverse direction relative to the cabinet; a second slide assembly mounted to the cabinet at the second side portion of the cabinet and being movable along the transverse direction relative to the cabinet; and a wire support frame mounted to and extending between the first slide assembly and the second slide assembly wherein the rack assembly comprises a tray that is removably mounted to the wire support frame, the tray comprising a recessed portion and a lip that extends about the recessed portion, the recessed portion of the tray disposed within the wire support frame and the lip of the tray positioned on the wire support frame when the tray is mounted to the wire support frame and further comprising a door positioned adjacent the opening of the cabinet, the first slide assembly and the second slide assembly coupling the door to the cabinet such that the door is movable along the transverse direction relative to the cabinet, the door being pivotable between a vertical position and a non-vertical position.

11. The rack assembly of claim 10, the rack assembly comprising:

a first support bracket mounted to the first slide assembly, the wire support frame being mounted to the first support bracket; and a second support bracket mounted to the second slide assembly, the wire support frame being mounted to the second support bracket.

12. The rack assembly of claim 10, wherein the wire support frame comprises a single piece of wire that is formed into a rectangle.

13. The rack assembly of claim 10, wherein the wire support frame is formed from metal by computer numerically controlled machining.

14. The rack assembly of claim 10, wherein the wire support frame is welded to the first support bracket and the second support bracket.

15. A double oven range appliance defining a vertical direction, a lateral direction, and a transverse direction, the vertical, lateral, and transverse directions being mutually perpendicular, the double oven range appliance comprising: a cabinet extending between a first side portion and a second side portion along the lateral direction, the cabinet also extending between a top portion and a bottom portion along the vertical direction, the cabinet defining an upper cooking chamber positioned adjacent the top portion of the cabinet and a lower cooking chamber positioned adjacent the lower portion of the cabinet, the cabinet also defining an opening for accessing the upper cooking chamber of the cabinet; a heating element positioned at the upper cooking chamber of the cabinet; a pair of slide assemblies mounted to the cabinet at the upper cooking chamber, each slide assembly of the pair of slide assemblies positioned at a respective one of the first and second side portions of the cabinet and being movable along the transverse direction relative to the cabinet; and a rack assembly mounted to and extending between the pair of slide assemblies along the lateral direction, the rack assembly comprising: a first support bracket mounted to the first slide assembly; a second support bracket mounted to the second slide assembly; and a wire support frame mounted to the first support bracket and the second support bracket wherein the rack assembly comprises a tray that is removably mounted to the wire support frame, the tray comprising a recessed portion and a lip that extends about the recessed portion, the recessed portion of the tray disposed within the wire support frame and the lip of the tray positioned on the wire support frame when the tray is mounted to the wire support frame.

16. The double oven range appliance of claim 15, wherein the wire support frame comprises a single piece of metal wire that is formed into a rectangle.

* * * * *